US007368043B2

(12) United States Patent
Mohanta et al.

(10) Patent No.: US 7,368,043 B2
(45) Date of Patent: May 6, 2008

(54) CONFIGURATIONS AND METHODS OF ELECTROCHEMICAL LEAD RECOVERY FROM CONTAMINATED SOIL

(75) Inventors: Samaresh Mohanta, Orinda, CA (US); Brian J. Dougherty, Menlo Park, CA (US); Scott Stevenson, Albuquerque, NM (US)

(73) Assignee: Applied Intellectual Capital, Reno, NV (US)

( * ) Notice: Subject to any disclaimer, the term of this patent is extended or adjusted under 35 U.S.C. 154(b) by 610 days.

(21) Appl. No.: 10/821,356

(22) Filed: Apr. 8, 2004

(65) Prior Publication Data

US 2004/0222085 A1 Nov. 11, 2004

Related U.S. Application Data

(60) Provisional application No. 60/462,160, filed on Apr. 10, 2003.

(51) Int. Cl.
*C25C 7/00* (2006.01)
*C25C 1/18* (2006.01)

(52) U.S. Cl. ..... 204/237; 204/263; 204/278.5

(58) Field of Classification Search ..... None
See application file for complete search history.

(56) References Cited

U.S. PATENT DOCUMENTS

| | | | | |
|---|---|---|---|---|
| 4,193,854 | A | | 3/1980 | Drnevich et al. |
| 4,585,539 | A | * | 4/1986 | Edson ..... 204/229.4 |
| 5,137,608 | A | | 8/1992 | Acar et al. |
| 5,316,751 | A | | 5/1994 | Kingsley et al. |
| 5,458,747 | A | | 10/1995 | Marks et al. |
| 6,264,720 | B1 | | 7/2001 | Schowanek et al. |

FOREIGN PATENT DOCUMENTS

WO WO 01/96631 A1 * 12/2001

* cited by examiner

*Primary Examiner*—Harry D Wilkins, III
(74) *Attorney, Agent, or Firm*—Fish & Associates, PC

(57) ABSTRACT

A soil remediation system includes an electrochemical cell that is configured to provide increased mass transfer and a decreased diffusion layer between the electrodes to thereby allow formation of a homogenous lead deposit that is substantially free of dendrite formation and easily removed.

13 Claims, 2 Drawing Sheets

CONFIGURATIONS AND METHODS OF ELECTROCHEMICAL LEAD RECOVERY FROM CONTAMINATED SOIL

This application claims the benefit of U.S. Provisional Patent Application with the Ser. No. 60/462,160, filed Apr. 10, 2003, which is incorporated by reference herein.

FIELD OF THE INVENTION

The field of the invention is electrochemical soil remediation, and especially as it relates to electrochemical recovery of lead from a lead-complex solution from contaminated soil.

BACKGROUND OF THE INVENTION

There are various methods of soil remediation of lead contaminated soil known in the art, however, all or almost all of them exhibit significant disadvantages. For example, lead can be removed from soil in situ using a complexing agent (e.g., EDTA: ethylenediamine tetraacetic acid) as described in U.S. Pat. No. 5,316,751. Where desired, alternative biodegradable complexing agents may be employed as described in U.S. Pat. No. 6,264,720. Lead-EDTA and other lead complexes are often highly stable and form relatively quickly over a relatively wide pH range. However, where such complexes are formed in situ, great care must be taken to avoid mobilizing the solubilized lead away from the site of contamination (e.g., into an aquifer).

Alternatively, lead may be electrochemically isolated from soil in a slurry by positioning the electrodes into the slurry as described in U.S. Pat. No. 4,193,854, or lead may be isolated from soil directly by placing the electrodes into the soil as described in U.S. Pat. Nos. 5,137,608 and 5,458,747. While such electrolytic methods often significantly reduce the risk of inadvertent contamination of uncontaminated areas, various difficulties remain. Among other things, and depending on the lead concentration, soil composition, and/or conductivity of the soil, electrochemical recovery may not be economically attractive. Moreover, electrochemical lead removal may not be practicable where the contaminated area is relatively large.

In still further known methods, lead can be extracted from a lead-EDTA solution that is electrolyzed to plate lead on a cathode. However, in such configurations, EDTA is typically electrochemically degraded at the anode, which renders such systems cost-ineffective. Moreover, as the concentration of the lead-EDTA complexes decreases, low mass transfer conditions are likely to develop and consequently electrolysis would operate under current limiting conditions. Such conditions will not only render electrolysis cost-ineffective, but also lead to generation of hydrogen, which is highly undesirable. Still further such conditions typically lead to dendritic lead deposits which are less useful and are difficult to recover.

Thus, although there are numerous configurations and methods for lead recovery are known in the art, all or almost all of them suffer from one or more disadvantages. Still further, disposal of the processing fluids and removal of the residual lead and EDTA from soil is often problematic. Therefore, there is still a need to provide improved compositions and methods for lead recovery from contaminated soil.

SUMMARY OF THE INVENTION

The present invention is directed to configurations and methods of lead recovery from an electrolyte in which lead is electrochemically plated from a complex formed between lead and a complexing agent in an electrochemical cell that provides forced flow of the electrolyte between the electrodes to provide increased mass transport, lower operating costs, and more effective removal of the target metal. The cell is preferably configured to enable protection of the organic complexing agent from oxidation at the anode so that the complexing agent can be recycled to the soil many times.

In another aspect, the target metal in the process fluids of the first cell system is removed in a second cell to a sufficiently low level that allows disposal of the electrolyte into the sewer without violating discharge limits. Such second cells are typically of specific value at the end of the treatment process for the site. Contemplated configurations generally allow removal of the target metal from soil to meet leach tests levels demanded by the Japanese environmental guidelines for the complexing agent and the target metal (which is currently more stringent in the US or Europe).

In one especially preferred aspect, contemplated electrolytic cells include an anode, a cathode, and an electrolyte comprising lead in complex with a complexing agent. A pump is fluidly coupled to the electrolytic cell and moves the electrolyte between the anode and cathode at a predetermined flow velocity, wherein the anode and the cathode are positioned relative to each other such that a flow path is formed between the anode and cathode from which lead is deposited onto the cathode at non-current limiting conditions at the flow velocity.

In such configurations, it is especially preferred that the cathode is disposed in a cathode container that contains the electrolyte, and/or that the anode is disposed in an anode container that includes an anolyte that is circulated between the container and an anolyte circulation tank, wherein the anode container is at least partially disposed in the cathode container. Further preferred anode containers include a separator (e.g., diaphragm or ion exchange polymer), and it is also contemplated that the cathode container is in fluid communication with a tank that contains the electrolyte.

Thus, in another aspect of the inventive subject matter, an electrolytic cell will include (1) a first container that contains an acidic catholyte comprising lead in complex with a complexing agent, wherein a cathode is at least partially disposed within the catholyte, (2) a pump that moves the catholyte across the cathode at a predetermined flow velocity, and (3) a second container that contains an anolyte, wherein the second container is at least partially disposed in the catholyte and comprises a separator that separates the catholyte from the anolyte, wherein the second container further comprises an anode, and wherein the cathode and the second container are positioned relative to each other such that a flow path between the second container and cathode is formed from which the lead is deposited onto the cathode at non-current limiting conditions at the predetermined flow velocity.

The first container in such electrolytic cells may advantageously include a first opening that receives the catholyte and a second opening that discharges the catholyte after the catholyte has contacted the second container, and it is further preferred that the first container is at least partially disposed in a tank that receives the catholyte from the second opening and that provides the catholyte to the first opening. While not limiting to the inventive subject matter, it is generally preferred that the acidic catholyte comprises sulfuric acid, that the complexing agent is ethylenediamine tetraacetic acid, and/or that the cathode comprises titanium and the anode comprises lead or iridium oxide coated titanium.

In further contemplated aspects, the anolyte (preferably comprising sulfuric acid) is provided to the second container from an anolyte circulation tank, and especially suitable separators include a diaphragm or an ion exchange polymer (e.g., Nafion). With respect to the concentration of lead in the electrolyte, it is preferred that the lead (preferably in complex with the complexing agent) has a concentration of less than 5000 ppm, more preferably less than 500 ppm, and most preferably less than 250 ppm.

Especially preferred flow velocities of the catholyte across the cathode are those that provide a Reynolds number (Re) of above 2000. Thus, exemplary preferred flow velocities are at least 0.05 m/sec (at a gap of about 2.54 cm), and more preferably at least 0.08 m/sec (at a gap of about 2.54 cm). Therefore, particularly preferred non-current limiting conditions are typically proportional to the metal concentration and Re.

In yet another especially preferred aspect, contemplated electrolytic cells may comprise an electrolyte reservoir that contains an electrolyte in which lead is complexed with a complexing agent. A first container is preferably at least partially disposed within the electrolyte reservoir, wherein the first container further includes a cathode, a first opening that receives the electrolyte from the electrolyte reservoir, and a second opening that provides the electrolyte back to the electrolyte reservoir, and a second container is at least partially disposed within the first container, wherein the second container further includes an anolyte and an anode, and wherein the anolyte in the second container is separated from the electrolyte in the first container by a separator. A pump is fluidly coupled to the electrolyte reservoir and moves the electrolyte from the electrolyte reservoir to the first container via the first opening at a rate effective to prevent formation of a diffusion layer in a flow path that is formed between the second container and the cathode.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
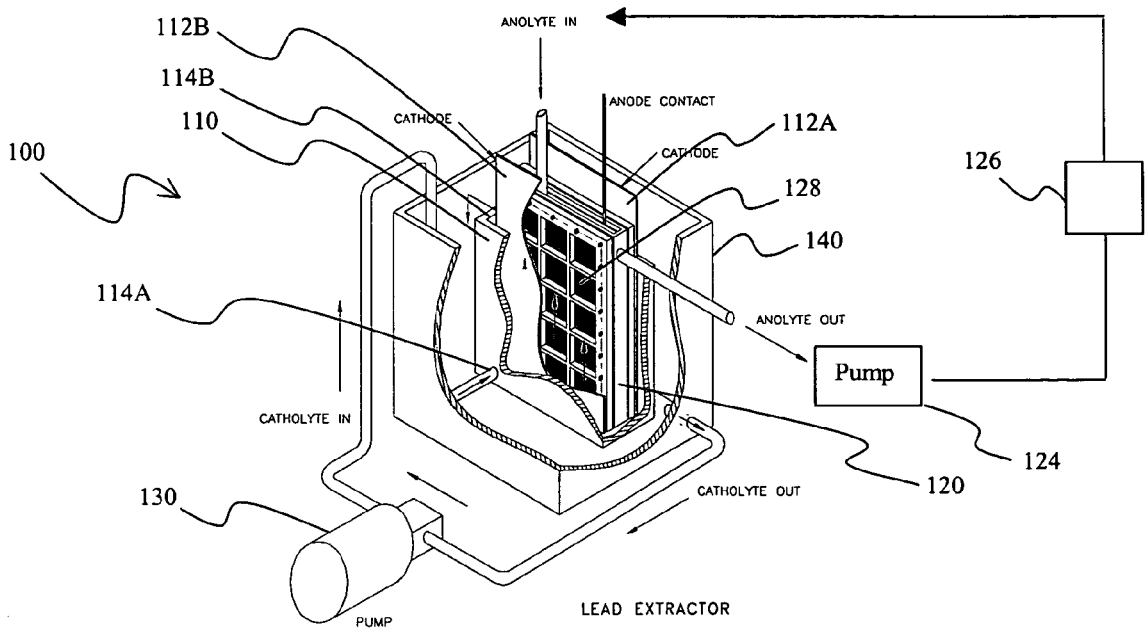
FIG. 1 is a schematic perspective view of an exemplary electrolytic cell according to the inventive subject matter.

The inventors have discovered that lead can be effectively plated, and most preferably as a smooth film from a solution comprising very low concentrations of lead, which is preferably in complex with a chelating agent. While lead deposition in form of a smooth layer has been known for high lead concentrations (typically 1M to 2M, and even higher), known configurations and methods, and especially under non-current limiting conditions, failed to remove lead from an electrolyte where the lead was present in low concentrations (i.e., less than 5000 ppm, more typically less than 500 ppm, and most typically less than 250 ppm). It should therefore be particularly recognized that contemplated configurations may be employed in remediation where the concentration of lead (or other metals, see below) is relatively low, and especially where the metal is to be removed in a commercially and/or technically attractive form (e.g., with a purity of at least 99%).

Contemplated electrolytic cells include those having a configuration that provides high mass transport conditions between the anode and cathode. Viewed from another perspective, the inventors discovered a cell configuration in which lead is electrolytically recovered at relatively low concentrations under non-current limiting conditions by avoiding formation of an inhibiting diffusion layer.

As used herein, the term "anode" refers to the electrode in the electrolytic cell at which oxidation occurs when current is passed through the electrolytic cell. Therefore, under typical operating conditions, molecular oxygen ($O_2$) is generated at the cathode from water. As also used herein, the term "anolyte" refers to the electrolyte that contacts the anode.

As used herein, the term "cathode" refers to the electrode in the electrolytic cell at which reduction occurs when current is passed through the electrolytic cell. Therefore, under typical operating conditions, elemental metals are plated onto the cathode from ionic metals (which may or may not be complexed with a chelating agent). As further used herein, the term "catholyte" refers to the electrolyte that contacts the cathode. In most embodiments according to the present inventive subject matter, the anolyte is separated from the catholyte via a separator that allows migration of a charged species from the anolyte to the catholyte (and vice versa), but is otherwise impermeable for the anolyte and catholyte.

As still further used herein, the term "non-current limiting condition" refers to a condition in which a metal, and most typically lead, is deposited from an electrolyte onto a cathode before the metal deposition reaches current limiting condition (i.e., a condition where increase of the cathode potential fails to proportionally increase the rate of deposition). Viewed from another perspective, deposition of the metal at the cathode occurs before complete mass transport control sets in (i.e., the rate of convective diffusion determines the rate of deposition). It should be particularly noted that as a consequence of metal deposition at non-current limiting conditions, the metal, and especially lead will plate at the cathode in form of a smooth film as opposed to a powdery, grainy, or dendritic deposit as would be the case at current limiting conditions. The term "smooth film" as used herein refers to a metal deposit that has an metal oxide content of less than 1% (e.g., less than 1% lead oxide in deposited lead) and an impurities content of less than 1% (e.g., less than 1% calcium, magnesium, sulfides, and/or salts in deposited lead).

As yet further used herein, the term "diffusion layer" refers to a concentration gradient of lead within the electrolyte, wherein the concentration of lead ions is lowest at or near the cathode (i.e., within less than 5 mm) and increases as the distance from the cathode increases, and wherein deposition of the lead onto the cathode at the concentration of lead at or near the cathode is at current limiting conditions. Thus, as used herein, the term "prevent formation of a diffusion layer" is synonymously used with the term "prevent current limiting conditions".

In one especially preferred aspect of the inventive subject matter, as depicted in FIG. 1, an electrolytic cell 100 has a nested and self-contained configuration in which an catholyte recirculation tank 140 includes a catholyte container 110 that in turn includes an anolyte container 120.

With further reference to FIG. 1, the catholyte container (first container) 110 includes an acidic catholyte (not shown), wherein the catholyte comprises lead in complex with a complexing agent. A first and a second cathode 112A and 112B are partially disposed within the catholyte, wherein the catholyte enters the cathode container via first opening 114A and leaves the cathode container via overflow at the open top (second opening 114B) of the cathode container. The overflowing catholyte is received by catholyte recirculation tank 140, from which pump 130 transports the catholyte back into the catholyte container via the first opening 114A.

Disposed within the catholyte container is an anolyte container (second container) 120 that contains anode 122 (not shown) and an acidic anolyte (not shown), which is circulated via a pump 124 to and from an anolyte circulation tank 126. The anolyte container further includes a separator 128 that is permeable for ions and contacts both the anolyte and catholyte.

Figure 2:
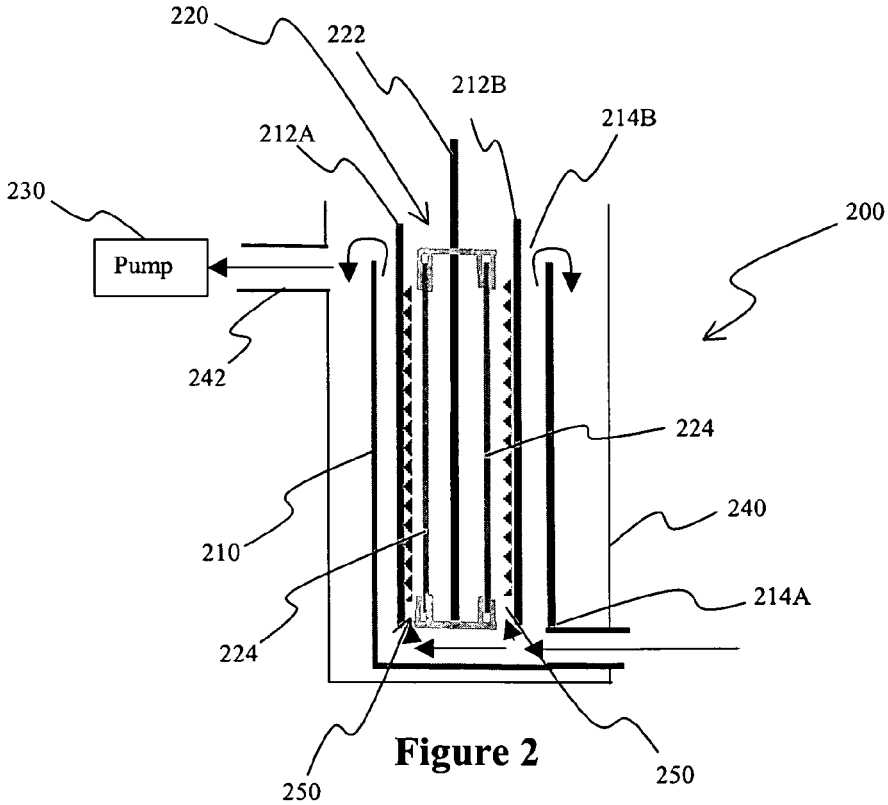
FIG. 2 is a schematic detail view of the exemplary electrolytic cell of FIG. 1.

FIG. 2 provides a schematic cross sectional detail view of the electrolytic cell of FIG. 1, in which the electrolytic cell 200 has a catholyte recirculation tank 240 with an outlet 242 that provides catholyte to the pump 230. At least partially disposed within the catholyte recirculation tank 240 is the catholyte container 210 that includes a first opening 214A through which the catholyte container receives the catholyte from the pump 230, and a second opening (here: open top) 214B from which the catholyte is fed to the catholyte recirculation tank 240 after the catholyte has contacted the cathode container 210. A pair of cathodes (cathodes 212A and 212B) is further at least partially disposed in the catholyte (within the cathode container 210).

Still further and at least partially disposed in the cathode container 210 is anode container 220 that includes an anode 222 at least partially disposed in the anolyte (not shown). The anode container 220 has a separator 224 (most preferably a NAFION™ [poly(tetrafluoroethylene) membrane, commercially available from DuPont] membrane) that separates the anolyte from the catholyte. A flow path 250 is formed between the cathodes 212A and 212B and the separators 224 of the anode container, wherein lead deposited from the flow path onto the cathodes is depicted as small triangles.

It should generally be appreciated, however, that numerous modifications to the above described systems may be made. For example, while lead is a preferred metal for electrolytic recovery, it is also contemplated that numerous alternative metals (and especially heavy metals) are suitable for use in conjunction with the teachings presented herein. Therefore, contemplated metals also include zinc, copper, cadmium, mercury, nickel, etc. It is further contemplated that the metal may occur bound to a solid phase (e.g., ionically bound to soil), in ionic form with a counter ion (e.g., as a salt deposit), or dissolved as an ionic species.

In especially preferred aspects of the inventive subject matter, the metal is solubilized into a liquid, and most preferably an electrolyte by leaching/isolating the metal from its location (e.g., from a solid phase or salt deposit) using a leaching agent. The term "leaching agent" as used herein is interchangeably used with the terms "complexing agent" and "chelating agent" and refers to a molecule that binds a metal ion via one or more (typically non-covalent) complex bonds to form a metal-complexing agent complex (e.g., lead that forms with EDTA a lead-EDTA complex). Further contemplated manners of solubilizing a metal include salt formation (e.g., metal/methanesulfonate salt).

Consequently, it should be recognized that the nature of the complexing agent may vary considerably, and all known complexing agents for metal ions are deemed suitable for use herein. Thus, especially preferred complexing agents include monodentate, bidentate, tetradentate, and polydentate complexing agents, which may or may not exhibit selectivity for a particular metal ion. For example, where the chelating agent comprises an organic acid, suitable complexing agents include citrate, poly(aspartate), EGTA, EDTA, etc. On the other hand, non-acid complexing agents may include those in which a nitrogen (or other non-carbon) atom in an aromatic ring is employed to bind the metal ion (e.g., nickel bound by nitrogen of an imidazole ring).

Where the metal ion is isolated from soil, and especially where the metal ion is lead, it should be recognized that the nature of the complexing agent may also vary depending on the type of soil (e.g., due to the presence of other ions that may potentially compete with the complexing agent, or due to the pH in the soil). For example, where the soil is a non-clay soil, EDTA may be employed as the complexing agent. On the other hand, where lead is to be isolated from a clay or clay rich (typically>20% clay) soil, methane sulfonic acid or sulfamic acid may be employed as a complexing agent. In such cases, it should further be recognized that acidity may be provided by the chelating agent (e.g., via deprotonation of free methane sulfonic acid). Furthermore, it should be recognized that the concentration of the complexing agent may vary considerably, and it is generally contemplated that the complexing agent may be present in sub-stoichiometric quantities, stoichiometric quantities, or in super-stoichiometric quantities. However, it is generally preferred that the chelating agent is present in at least stoichiometric quantities.

Therefore, contemplated electrolytes (and particularly contemplated catholytes) will vary substantially and the particular composition will generally depend on the metal and complexing agent of choice (supra). Still further, it is generally preferred that the pH of the catholyte is less than 7.0, but higher pH values are not excluded.

In a particularly preferred aspect of the inventive subject matter, the catholyte is generated by contacting metal contaminated soil with a solution that comprises the chelating agent at a suitable pH. In such configurations, the contaminated soil may be excavated and then flushed (batch-wise or continuously) with the solution that comprises the chelating agent. Alternatively, the soil may also be contacted in situ with the solution that comprises the chelating agent to generate the catholyte. The so generated catholyte may then be further processed before use in electrolytic recovery of the metal, and especially contemplated processing steps include filtration, acidification or alkalinification for adjustment of pH, addition of chelating agent, salt, or other component.

With respect to the anolyte, it is generally preferred that the anolyte is an aqueous acidic solution (e.g., sulfuric acid). However, in alternative aspects the nature and composition of the anolyte may vary substantially. For example, suitable anolytes may be neutral (i.e., pH between about 6.5 to about 7.5), or include a solvent other than water. Still further, suitable anolytes may also include one or more species of salt to increase conductivity or to enhance other desirable properties. Numerous anolytes for metal deposition electrolysis are known in the art, and all of them are considered suitable for use herein.

In further preferred aspects of the inventive subject matter, the catholyte recirculation tank has a capacity of at least three times the volume of the container and further includes at least one port through which catholyte is withdrawn (that previously contacted the catholyte container and/or the cathode). In alternative aspects, the configuration of the catholyte recirculation tank may vary substantially. For example, the volume of the catholyte recirculation tank may be less than three time the volume of the catholyte container where the volume of catholyte is relatively low, or where multiple catholyte recirculation tanks are employed. Alternatively, and especially where the catholyte is generated in situ, the catholyte recirculation tank may be in form of a pipeline that is fluidly coupled to the site where the catholyte is generated. On the other hand, it should also be appreciated that the catholyte may be generated from contaminated soil in the catholyte recirculation tank. In such (and other) configurations, it should be recognized that the volume of the catholyte recirculation tank may be significantly higher than three times the volume of the cathode container. Thus, viewed from another perspective, suitable catholyte recirculation tanks will generally be fluidly coupled to the cathode container and at least receive catholyte from the cathode container, and more preferably at least partially include the cathode container.

Similarly, the configuration of contemplated catholyte containers may vary considerably. However, it is generally preferred that the cathode container receives catholyte from the catholyte recirculation tank and includes (a) at least one opening that provides the catholyte (after contact with the cathode) to the catholyte recirculation tank, and (b) at least one cathode. In further especially preferred aspects, it is contemplated that the cathode container is configured to at least partially fit within the catholyte recirculation tank, and that at least part of the catholyte travels upwardly along a flow path (infra) that is formed between a cathode and the anode container. Thus, suitable cathode containers will include one or more ports in a lower portion (i.e., below the midpoint of the container) through which catholyte enters the cathode container, and one or more openings (and most preferably an at least partially open top as shown in FIG. 1) in an upper portion (i.e., above the midpoint of the container) through which catholyte leaves the cathode container.

Alternative cathode containers may have numerous configurations other than those describes above so long as such cathode containers receive catholyte from the cathode recirculation tank and provide catholyte back to the catholyte recirculation tank after that catholyte has flown through the cathode container. For example, suitable cathode containers may have a cylindrical shape where the catholyte recirculation tank is also cylindrical. Furthermore, where appropriate, more than one cathode container may be at least partially positioned within the catholyte recirculation tank. In such configurations, it should be recognized that the catholyte may flow from one cathode container to the next catholyte container, and from the last cathode container back to the catholyte recirculation tank in a serial configuration. Alternatively, the catholyte may also flow from each cathode container back to the catholyte recirculation tank in a parallel configuration.

It is generally further preferred that suitable cathode containers will include two cathodes, wherein the two cathodes are separated from each other by the anode container. Thus, each cathode container will include at least two distinct flow paths for the catholyte (infra). With respect to the cathode material, it is contemplated that all conductive materials are appropriate so long as such materials will allow deposition of the metal onto the cathode. However, it is generally preferred that the cathode comprises, and most preferably is fabricated from titanium. Still further contemplated alternative cathode materials include carbon, stainless steel, titanium, nickel-plated iron, precious metal coated titanium, conductive plastics, lead, and all reasonable combinations and alloys thereof.

It is generally preferred that the anolyte container is configured such that (a) the anolyte container can be juxtaposed to at least one cathode, and more preferably positioned between a pair of cathodes, and (b) that the anolyte container forms a flow path in cooperation with at least one cathode in the cathode container. Especially preferred anode containers will include an anode that is at least partially disposed within an anolyte, wherein the anolyte is preferably circulated between the anode container and an anolyte recirculation tank. It should be especially recognized that such configurations advantageously allow for release of oxygen gas generated at the anode as well as for cooling to at least some degree.

Suitable anode containers further include at least one, and more preferably at least two separators that separate the anolyte from the catholyte while allowing the flow of charged species, and especially the flow of cations and protons. Therefore, particularly suitable separators include diaphragms and ion exchange polymers (e.g., NAFION™) well known in the art, and all of such separators are considered suitable for use in conjunction with the teachings presented herein.

With respect to the anode it is generally contemplated that all conductive materials are appropriate so long as such materials will allow electrolytic conditions that provide a current suitable for deposition of the metal onto the cathode in the cathode container. However, it is generally preferred that the cathode comprises, and most preferably is fabricated from lead or iridium oxide coated titanium. Still further contemplated alternative anode materials include carbon, platicarbon, platinized titanium, stainless steel, nickel, lead, and all reasonable combinations and alloys thereof.

It should be especially appreciated that the flow channel in contemplated electrolytic cells is formed between the cathode and the anode container and configured such that mass transport is increased at the electrode interface by increasing turbulence and/or flow velocity. Viewed from another perspective, the flow channel in contemplated electrolytic cells has a configuration such that an otherwise forming diffusion layer is disturbed, or even completely eliminated by the flowing electrolyte. The inventors discovered that without such configurations, the concentration of the metal in the catholyte would decline at the cathode surface as electrolysis increasingly depletes the concentration of metal, which in turn would results in current limiting conditions and formation of hydrogen gas. Further suitable electrolytic cells are described in our provisional patent application Ser. No. 60/485879, which was filed Jul. 8, 2003, and which is incorporated by reference herein.

Consequently, and among other advantages, contemplated configurations will provide a substantially increased current efficiency over known configurations (typically static systems or systems with a stir bar) and removal of metal ions from the catholyte below previously achieved concentrations at comparable energy costs. Moreover, the metal and especially lead deposited onto cathodes in contemplated systems will form a smooth film which can be easily removed (typically peeled) from the cathode. In contrast, electrodeposition in known electrochemical cells will typically result in grainy, powdery deposits, and more typically result in dendrite formation eventually leading to puncture of the separator or short-circuits in systems without separators.

It should be recognized that there are numerous manners of forming a flow channel, and all of such manners are contemplated herein. However, it is generally preferred that the flow channel is directly formed between the cathode and the anode container as depicted in FIGS. 1 and 2. Here, an upward flow path is formed by supplying catholyte to the bottom of the catholyte container and placing the cathodes and anode container such that a significant portion (i.e., at least 25 vol %, more typically at least 50 vol %, and most typically at least 80 vol %) of the catholyte entering the cathode container will pass between the cathode and the anode container and exit the open top of the cathode container as overflow.

In alternative aspects and where appropriate, it is contemplated that the cathode and/or anode container (including the separator) may further comprise protrusions that will increase and/or induce turbulent flow between the anode container and the cathode. Alternatively, funnels or jets may be directed between the cathode and anode container to disturb formation of a diffusion layer. In still further contemplated embodiments, it should be recognized that numerous other flow paths may be formed, and all of such flow paths are deemed suitable so long as such flow paths will prevent formation of a diffusion layer at a predetermined flow velocity. Prevention of formation of a diffusion layer can be ascertained by a person of ordinary skill in the art in a relatively simple manner by visual confirmation that the metal deposited is in form of a smooth film, or by observation that the metal is deposited under non-current-limiting conditions at a given flow velocity.

With respect to the flow velocity, it is generally contemplated that the flow velocity will be at least in part determined by the current density and/or concentration of the metal in the catholyte. Therefore, numerous flow velocities are deemed suitable, and it should be recognized that a person of ordinary skill in the art will be readily able to determine the flow velocity on an empirical basis. Furthermore, it should be recognized that the flow velocity may be adjusted over the course of an electrolytic recovery of the metal.

Viewed from another perspective, it should be recognized that the cathode and the anode (or anode container) are positioned relative to each other such that the flow velocities in the flow path provides for a Reynolds number (Re) of at least 2000. Therefore, the limiting current density in the flow path will be generally proportional to the metal concentration and the Re.

Observations and Experimental Data

The relationship between electrical current and cathode potential for metal deposition can be experimentally determined and is schematically depicted for copper deposition from an acid sulfate solution in Graph 0 below. As the cathode potential is made more negative than the open circuit potential, the current (and therefore the rate of copper deposition) increases. At sufficiently negative potential, the rate of metal deposition reaches a maximum in the limiting current ($I_L$) plateau region. Here, the rate of cupric ion removal is dominated by the rate at which copper ions are supplied to the cathode (typically by convective-diffusion), which is also known as complete mass transport control. If the potential is too negative, the current once again rises due to secondary reactions (e.g., hydrogen evolution).

Under completely mass transport controlled conditions, the rate of metal ion removed is thus given by Faraday's laws of electrolysis, and can be expressed as $$\frac{dw}{dt} = \frac{\varphi IM}{zF} \tag{1}$$

where w is the mass of metal, t is the time, ϕ is the cathode current efficiency, I is the current, M is the molar mass of metal, z is the number of electrons and F is the Faraday constant. Consequently, it should be appreciated that high values of current efficiency should be maintained while limiting current density and cathode area to secure a high rate of metal ion removal from an electrolyte. On the other hand, for a batch electrolyte of volume V, the change in molar concentration of metal ions due to electrochemical reactions, Δc, may be therefore be expressed as:

$$\Delta c = \frac{I\varphi Mt}{zFV} = \frac{j_L A\varphi Mt}{zFV} \tag{2}$$

which shows the importance of maintaining a large cathode area, a high limiting current density ($j_L$) and a high current efficiency.

The mass transport coefficient $k_m$ is defined as:

$$k_m = \frac{j_L}{zFc} = \frac{I_L}{AzFc} \tag{3}$$

where $j_L$ is the limiting current density, $I_L$ is limiting current and c is the concentration of metal ions in the bulk solution. Combining equations (1) and (3) gives an expression for the maximum rate of metal ion removal:

$$\frac{dw}{dt} = ck_m AM \tag{4}$$

which clearly indicates the importance of maintaining high current efficiency, mass transport, cathode area and bulk concentrations of metal ions. Where it is particularly desirable to obtain thick and smooth films of a metal from a dilute electrolyte, the inventors concluded from the observations above that mass transport at the electrode interface is critical and should be increased as much as possible. Among other possible mechanisms, mass transport can be substantially increased by increasing turbulence, and/or providing a high flow velocity at the cathode.

EXAMPLE 1

Recovery of Lead from Contaminated Soil

The inventors tested a configuration in which lead-contaminated soil was placed in large bins and washed with an electrolyte containing EDTA to form the catholyte from which the lead was subsequently recovered in a electrolytic cell. The treated electrolyte was then used to re-wash the lead-contaminated soil, thereby removing more lead from the contaminated soil. The process of soil-wash followed by recovery of lead in the electrolytic cell was repeated as long as necessary to reduce the concentration of lead in the soil to the desired value.

The electrolytic cell was designed as a classical tank electrolyzer with a pumped flow system as depicted in FIG. 1 to ensure generate high mass transfer conditions in the cell. Previous experiments indicated that a relatively low flow would have reduced the current at which one can plate smooth film deposits so that the lead could easily be harvested from the cathodes.

The anode, here a lead-antimony alloy, was placed in a box which had two membranes fitted as windows either side of the anode. The box was filled with electrolyte, 5-10% sulfuric acid, which was pumped around the box and back to an exterior anolyte tank so that the oxygen generated at the anode could escape to the atmosphere. Circulating anolyte provided some cooling effect so that continuous operation was possible.

The cathodes were placed exterior to the anode box opposite the membrane windows. The catholyte, the lead EDTA rich electrolyte from the soil leaching, was pumped from a holding tank into the outside box and allowed to overflow into a third box and back to a second holding tank. The catholyte was subject to several passes through the electrolytic cell until the lead concentration in the electrolyte reached a point where it was denuded enough for the electrolyte to be successful as a leaching agent again. Note that the EDTA becomes a free acid or a mixed calcium/sodium solution depending upon the pH of the reaction and the other cations present in the system.

Figure 3:
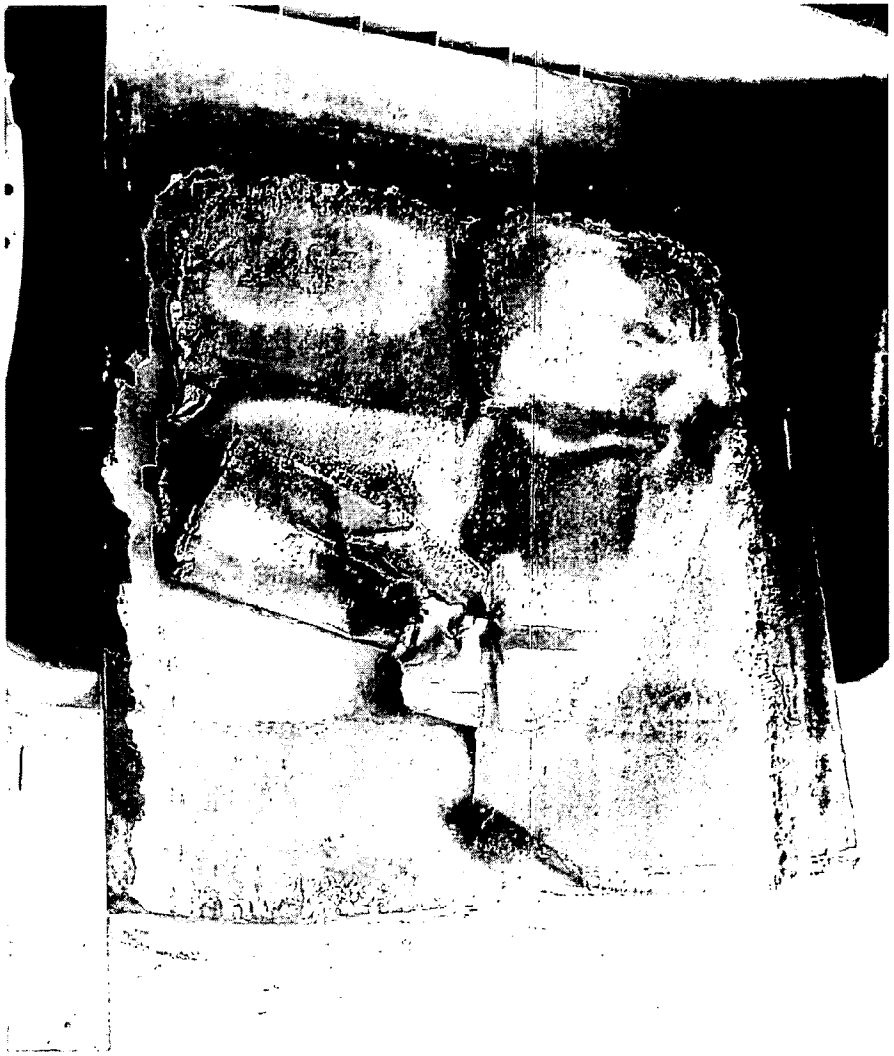
FIG. 3 is a picture of a cathode of an electrolytic cell according to the inventive subject matter showing a partially-scraped lead plate.

Graph 2 below shows the concentration of lead in the electrolyte for several passes through the contaminated soil. Each curve in this graph represents a separate soil treatment. Each point in a selected curve represents a separate pass through the electrolytic cell. Following the first treatment of the soil, the lead concentration in the EDTA solution was about 8000 ppm. This was reduced to about 5500 ppm after four passes through the electrolytic cell; the lead was recovered as foil plated on the cathodes (FIG. 3). Following the second soil treatment, the lead concentration in the EDTA increased to 13,000 ppm, which was further reduced to 8000 ppm after four passes through the cell, before again being used to treat the soil, thus demonstrating that the EDTA solution could be re-used. By the eighth soil treatment, the amount of lead in the soil had been reduced to the point where the concentration of lead in the EDTA solution immediately following the soil treatment was about 2500 ppm. This was reduced to about 1000 ppm after five passes through the electrolytic cell. As was the case with the higher lead concentrations, the lead was recovered as foil plated on the cathodes.

Graph 3 below depicts the amount of lead plated on the cathodes and cumulative plating efficiency throughout the test. The faradaic efficiency of lead plating ranged from 70% at the higher lead concentrations to as low as 20% at the lower concentrations, however, in all cases the lead plate was obtained as foil. The cumulative efficiency was about 57% throughout much of the plating operation, decreasing to about 42% at the end of operations due to the lower lead concentration the electrolyte.

FIG. 3 of a cathode of an electrolytic cell according to the inventive subject matter showing a partially-scraped lead plate. Apart from the inclusion of a membrane, the exemplary cell was substantially configured as a tank electrolyzer with a forced flow over the cathodes. Various modifications to the depicted configuration clearly indicated that a forced flow directed over the inside space between the cathode inner face and the membrane was critical to lead deposition onto the cathodes as a smooth film.

While not wishing to be bound by any particular theory or hypothesis, the inventors contemplate that maintaining a high flow between the gap will ensure high mass transport conditions as the diffusion layer is disturbed by the flowing electrolyte. Without such flow, the concentration of the metal would decline at the surface as electrolysis depleted the concentration of target metal, which would allow formation of hydrogen gas and current limiting conditions described above.

Such configurations become particularly critical as the target metal concentration declines during the remediation process. Formation of dendritic deposits that are generally difficult to remove from a cathode and often threaten the membrane or cause other problems (e.g. short-circuiting). In contrast, the present cell configuration allowed the inventors to deploy an inexpensive, self-contained, and portable system to contaminated sites. Exemplary cells were operated day and night with minimum attention and formed smooth metal films that could be easily removed as plated lead from the cathode. Moreover, the exemplary cells allowed lead deposition from much weaker solutions (with respect to lead concentration) that would be viable with common tank electrolyzers. In still further advantageous aspects, contemplated cells were also operated under current limiting conditions and above to further deplete the electrolyte of the metal. Consequently, it should also be recognized that contemplated cells may be operated under conditions to produce metal deposits in a form other than a smooth film (e.g., in form of a powdery or granular deposit, or in form of dendrites.

EXAMPLE 2

Reduction of Lead-EDTA & Copper-EDTA Complexes with Concurrent Oxidation of EDTA A four-chamber electrolytic cell comprising two carbon felt electrodes, one used as anode the other as a cathode, was assembled. The carbon-felt electrodes were fabricated by attaching a porous carbon felt onto a titanium mesh surface. A NAFION™ ion-exchange membrane was used to separate the two halves of the cell. The cell was configured so that the electrolyte was pumped from a reservoir into the chamber in front of the electrode, (i.e. between the electrode and the membrane), flowed through the porous electrode, into the chamber behind the electrode, and then returned to the reservoir.

One kg of soil containing about 1600 mg/kg lead and other metals (primarily copper, zinc and iron) was stirred with 10 liters of a 0.1 M EDTA solution and mixed for 24 hours. The slurry was filtered to separate the soil from the treatment liquor. The soil was washed with three pore volumes of water and drained. Approximately three liters of the treatment liquor, now containing low concentrations of copper-EDTA, iron-EDTA, zinc-EDTA and lead-EDTA complexes was placed in a tank and fed to the cathode side of the electrolytic cell described above. A second part of the treatment liquid, also about three liters, was placed in a second tank and fed to the anode side of the cell.

Graph 3 below shows the concentrations of copper, lead, zinc and iron in the EDTA solution as a function of treatment time in the cell. The cell was operated at a current density of about 100 $A/m^2$. The copper concentration was reduced from 260 mg/l to non-detect (less than 0.1 mg/l) in less than an hour at better than 90% faradic efficiency. Lead was plated once all of the copper has been plated; the lead concentration was reduced from 190 mg/l to less than 0.7 mg/l in about two hours, corresponding to about 20% faradic efficiency. Iron and zinc do not plate under the conditions of this experiment (the presence of EDTA interferes with plating of iron; the present of iron interferes with plating of zinc).

Graph 4 below shows the decrease in free EDTA concentration (i.e. EDTA that is not complexed with metals) with time of operation of the cell. Note that at the pH of this test, between 4 and 6, the prevalent form of EDTA is the divalent $H_2EDTA^{2-}$ anion. The concentration of EDTA was monitored titrimetrically, by measuring its ability to complex a standard solution of $ZnSO_4$. Consequently, the concentration of EDTA shown in the figure is actually the concentration of all species that will complex with zinc. It is likely that these include some of the initial daughter ions, which is why the rate of loss of EDTA appears to increase after five hours.

This example illustrates how the residual lead in the electrolyte after the operation of the main high flow cell, is removed to very low limits as plated lead onto a very high surface area cathode. As this solution is to be disposed of rather than recovered, it is essential that the electrolysis removes lead completely at the minimum cost for the operation. It is further important to destroy any remaining complexing agents to avoid solubilization of other toxic metals. As this process is of no economic advantage, efficiency and operating cost are the main consideration provided the efficacy of the operation is not compromised. The high surface area divided cell meets these criteria.

EXAMPLE 3

Stabilization of Lead in Treated Soil

A final requirement is to remove or immobilize any remaining lead in the soil such that it will pass any leaching process after the remediation process is complete. The following example demonstrates this by the use of ferric chloride solution. This stabilizer was chosen because iron is beneficial in soils and is benign. Therefore, a suitable method of immobilizing lead ions in soil previously treated with a complexing agent will comprise a step of admixing a ferric chloride containing solution to the soil. Further, some iron is lost in the process and should be replaced. Other washing agents have been used successfully, hypochlorite, lignin sulfate, calcium chloride, calcium sulfide etc. The iron chloride example is given here to illustrate the method.

Soil containing about 1600 mg/kg lead and other metals (primarily copper, zinc and iron) was stirred with a 0.1 M EDTA solution at 10% solids and mixed for 24 hours. The slurry was filtered to separated the soil from the treatment liquid. The soil was washed with three pore volumes, PV, of water and allowed to drain. (Note: one PV~0.2 ml/g soil). Following this step, the soil was treated with approximately three PV of 0.1 M ferric chloride solution. The slurry produced was stirred on a magnetic stirrer for two hours, and then filtered to recover the soil. The soil was then washed with another three pore volumes of water, before finally being air dried until it reached approximately the same moisture content as the original soil.

At each stage of the process, a sample of the soil was set aside for analysis to determine the effectiveness of the treatment. Analytical methods used were the Japanese test method for total lead (digestion of the soil in 1 M HCl for two hours, 33.3 ml solution/g soil, using 6 to 7 g of soil) and a modified version of the Japanese Elution Test for leachable lead (agitation of 50 g soil with 500 ml of pH 6.0 HCl solution for six hours). The modification on the Japanese Elution Test procedure was that the eluant solution was prepared by serial dilution of a $10^{-3}$ mol $dm^{-3}$ HCl solution (using 18.4 MΩ DI water), until HCl concentration was nominally $10^{-6}$ mol $dm^{-3}$ rather than the proscribed eluant, which is DI water adjusted to a pH between 5.8 and 6.3 via addition of HCl. The variation was used because pH meters and test strips do not provide accurate pH readings in high purity (low conductivity) solutions.

Treatment of the soil in the manner described above reduced the total amount of lead in the soil from about 1300 mg/kg initially to between 100 and 140 mg/kg, a reduction of approximately 90%. This treatment met the required standard of the Japanese total lead test, which is for the lead concentration to be less than 150 mg/kg.

Table 1 below shows the results of the elution test. Following the initial treatment with EDTA and the first water wash, the amount of leachable lead in the soil, primarily in the form of the soluble lead-EDTA complex in the soil pore-water, was increased by an order of magnitude. The secondary treatment step, using $FeCl_3$, reduced the amount of leachable lead by approximately two orders of magnitude, and the subsequent final wash with water reduced the amount of leachable lead further, to reach the required standard.

| SAMPLE DESCRIPTION | LEACHABLE LEAD, mg/L |
|---|---|
| Initial Soil Sample | 0.3 |
| Primary Treatment (EDTA + water wash) | 4.7 |
| Secondary Treatment (0.1M $FeCl_3$, no water wash) | 0.027 |
| Secondary Treatment (0.1M $FeCl_3$, + water wash) | 0.009 |
| Standard to pass test | 0.010 |

Thus, specific embodiments and applications of electrochemical soil remediation have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An electrolytic cell comprising:

a first container containing an acidic catholyte, wherein the catholyte comprises a metal, optionally in complex with a complexing agent, and wherein a cathode is at least partially disposed within the catholyte, and wherein the first container has a first opening that is configured to receive the catholyte and a second opening that is configured to discharge the catholyte after the catholyte has contacted the second container;

wherein the first container is at least partially disposed in a tank that is configured to receive the catholyte from the second opening and that is configured to provide the catholyte to the first opening;

a pump fluidly coupled to the first container and configured to move the catholyte across the cathode at a predetermined flow velocity;

a second container containing an anolyte, wherein the second container is at least partially disposed in the catholyte, wherein the second container comprises a separator that separates the catholyte from the anolyte, and wherein the second container further comprises an anode; and wherein the cathode and the second container are positioned relative to each other such that a flow path between the second container and cathode is formed from which the metal is deposited onto the cathode at non-current limiting conditions at the flow velocity.

2. The electrolytic cell of claim 1 wherein the acidic catholyte comprises sulfuric acid, and wherein the complexing agent is ethylenediamine tetraacetic acid.

3. The electrolytic cell of claim 1 wherein the cathode comprises titanium, and wherein the anode comprises lead or iridium oxide coated titanium.

4. The electrolytic cell of claim 1 wherein the anolyte is provided to the second container from an anolyte circulation tank, and wherein the anolyte comprises sulfuric acid.

5. The electrolytic cell of claim 1 wherein the separator comprises a diaphragm or an ion exchange polymer.

6. The electrolytic cell of claim 1 wherein the metal has a concentration of less than 5000 ppm.

7. The electrolytic cell of claim 1 wherein the metal has a concentration of less than 500 ppm.

8. The electrolytic cell of claim 1 wherein the predetermined flow velocity of the catholyte across the cathode is at least 0.08 in/sec.

9. The electrolytic cell of claim 1 wherein the metal is deposited as a smooth film.

10. An electrolytic cell comprising:

an electrolyte reservoir that contains an electrolyte in which lead is complexed with a complexing agent;

a first container at least partially disposed within the electrolyte reservoir, wherein the first container further includes a cathode, a first opening that receives the electrolyte from the electrolyte reservoir, and a second opening that provides the electrolyte back to the electrolyte reservoir;

a second container at least partially disposed within the first container, wherein the second container further includes an anolyte and an anode, wherein the anolyte in the second container is separated from the electrolyte in the first container by a separator; and a pump fluidly coupled to the electrolyte reservoir and moving the electrolyte from the electrolyte reservoir to the first container via the first opening at a rate effective to prevent formation of a diffusion layer in a flow path that is formed between the second container and the cathode.

11. The electrolytic cell of claim 10 wherein the complexing agent is ethylenediamine tetraacetic acid and wherein the electrolyte further comprises an acid.

12. The electrolytic cell of claim 10 wherein the separator is a diaphragm or an ion exchange polymer.

13. The electrolytic cell of claim 10 further comprising an anolyte circulation tank that is fluidly coupled to the second container.

* * * * *